US008989986B2

(12) United States Patent
Stankovic et al.

(10) Patent No.: US 8,989,986 B2
(45) Date of Patent: Mar. 24, 2015

(54) METHOD AND DEVICE FOR ASCERTAINING THE APPROACH OF THE LEAN BLOW OFF OF A GAS TURBINE ENGINE

(75) Inventors: Dragan Stankovic, Nussbaumen (CH); Marta De-La-Cruz-Garcia, Zürich (CH); Franklin Marie Genin, Nussbaumen (CH)

(73) Assignee: Alstom Technology Ltd., Baden (CH)

( * ) Notice: Subject to any disclaimer, the term of this patent is extended or adjusted under 35 U.S.C. 154(b) by 253 days.

(21) Appl. No.: 13/217,135

(22) Filed: Aug. 24, 2011

(65) Prior Publication Data

US 2012/0053810 A1 Mar. 1, 2012

(30) Foreign Application Priority Data

Aug. 30, 2010 (EP) ..... 10174540

(51) Int. Cl.
*G06F 19/00* (2011.01)
*F23N 5/24* (2006.01)

(52) U.S. Cl.
CPC ..... *F23N 5/242* (2013.01); *F23N 2041/20* (2013.01)
USPC ..... 701/99

(58) Field of Classification Search
CPC ..... G05D 1/00; B60T 7/12; G06G 7/70
USPC ..... 701/99, 100, 101, 103, 108
See application file for complete search history.

(56) References Cited

U.S. PATENT DOCUMENTS

| | | | | |
|---|---|---|---|---|
| 5,878,566 | A | 3/1999 | Endo et al. | |
| 6,026,644 | A | 2/2000 | Ito et al. | |
| 2002/0033014 | A1 | 3/2002 | Endo et al. | |
| 2009/0234555 | A1 * | 9/2009 | Williams et al. | 701/100 |
| 2010/0076698 | A1 * | 3/2010 | He et al. | 702/35 |
| 2012/0036863 | A1 * | 2/2012 | Kirzhner et al. | 60/776 |

* cited by examiner

*Primary Examiner* — Kim T Nguyen
(74) *Attorney, Agent, or Firm* — Buchanan Ingersoll & Rooney PC

(57) ABSTRACT

A method is provided for determining the approach of the lean blow off (LBO) of a gas turbine engine having at least one combustion chamber into which a fuel is supplied and burnt generating a flame. The method includes determining a value indicative of the gas temperature in recirculation areas adjacent to the flame, and identifying the lean blow off (LBO) approach on the basis of this value. A device for determining the approach of the lean blow off (LBO) is also disclosed.

16 Claims, 3 Drawing Sheets

METHOD AND DEVICE FOR ASCERTAINING THE APPROACH OF THE LEAN BLOW OFF OF A GAS TURBINE ENGINE

FIELD OF INVENTION

The present invention relates to a method and device for determining the approach of the lean blow off of a gas turbine engine.

The present invention may be implemented in standard gas turbine engines having a compressor, a combustion chamber and a turbine, in sequential combustion gas engines having a compressor, a first combustion chamber, a high pressure turbine, a second combustion chamber and a low pressure turbine, and also in gas turbine engines with a flue gas recirculation system.

BACKGROUND

Gas turbine engines have a combustion chamber wherein a fuel is introduced and mixed with an oxygen-containing fluid (an oxidizer, typically air), generating a mixture that is combusted, to generate hot gases that are expanded in a turbine.

In particular, the combustion chamber has mixing devices connected to a combustion device; the fuel is introduced into the mixing devices such that as it passes through it, it mixes with the oxygen containing fluid and increases its temperature; then when the fuel enters the combustion device, it burns.

The described operation mode requires that the reactivity conditions be comprised in a correct window, such that combustion neither starts too early (where it would cause so called flashback, i.e. combustion in the mixing devices) nor too late.

Reactivity conditions depend on a number of factors and, in particular, on the fuel temperature and oxygen concentration of the environment housing the fuel; in particular, reactivity increases (meaning that reactions in the combustion process accelerate) with increasing of the fuel temperature and oxygen concentration, whereas it decreases with decreasing of fuel temperature and oxygen concentration.

In some cases the gas turbine engine may operate at actual reactivity conditions that are different (in particular lower) from the design reactivity conditions.

Operation with fuel at reduced reactivity conditions may for example occur at part load (since the temperature of the flame is lower than the flame temperature at full load) or in case the external temperature is very low (external temperature influences the temperature within the combustion chamber) or in case the oxygen concentration is low (for example when the gas turbine engine operates together with a flue gas recirculation system).

When operating under reduced reactivity conditions, the flame operation is close to extinction and typically, because of non-uniformities in fuel or air distribution, some mixing devices may be extinct (i.e. the mixture generated by them does not burn) whereas other may not.

In addition, in the worst cases, operation with fuel at reduced reactivity conditions may also lead to flame extinction (lean blow off or lean blow out, in short LBO).

It is therefore greatly important to ascertain when LBO is approaching, such that countermeasures can be carried out before the flame extinguishes.

FIG. 3 shows a traditional control system of a traditional gas turbine engine 1.

FIG. 3 shows a plenum 2 containing a combustion chamber 3 having a mixing device 4 and a combustion device 5.

The engine 1 has a control system with a pressure sensor 6 detecting the pressure within the combustion device 5 and a further pressure sensor 7 detecting the pressure within the plenum 2 (since the cross sections are very large and the flow velocities are consequently low, the pressure within the combustion device 5 and plenum 2 substantially corresponds to the static pressure).

The sensors 6, 7 are connected to a control unit 8 that drives the engine 1 on the basis of the relationship plotted in FIG. 5.

FIG. 5 shows the function $\zeta$ (it is a function of the pressure difference $\Delta p$ measured through the sensors 6 and 7).

Typically the engine 1 is operated in zone R; in case of lean operation (part load, operation with flue gas recirculation, etc) the operating point may move into zone L.

As shown in FIG. 5, the curve describing the relationship between $\zeta$ and the reactivity is flat in zone L (it is also flat at the other side of zone R).

For this reason, when the LBO approaches, $\zeta$ remains substantially constant until the LBO is reached and the flame extinguishes; therefore $\zeta$ cannot be used to drive the engine operation in the zone L keeping the operating point at a safe distance from the LBO.

In addition, even if when LBO approaches usually CO and UHC (Unburnt Hydro Carbons) emissions strongly increase, the flame shifts downstream (toward the combustion device outlet) and strong low frequency pulsations appear, none of these indicators can be directly connected to the LBO, in other words there is no value of CO or UHC, flame shifting or low frequency pulsations that can indicate that LBO (and thus flame extinction) is imminent.

When the engine is operated with flue gas recirculation the situation is even worse, since typically before the LBO is reached and the flame is extinct no dramatic change in CO, UHT or pulsation is experienced.

SUMMARY

The present disclosure is directed to a method for determining approach of lean blow off of a gas turbine engine having at least one combustion chamber, into which a fuel is supplied and burnt generating a flame. The method includes determining a value indicative of a gas temperature in recirculation areas adjacent to the flame, and identifying the lean blow off (LBO) approach based on the value.

In another aspect, the present disclosure is directed to a device for determining the approach of the lean blow off (LBO) of a gas turbine engine having at least one combustion chamber into which a fuel is supplied and burnt generating a flame. The device includes a computer system configured to receive at least one value indicative of a gas temperature in recirculation areas adjacent to the flame. The computer system recognizes the lean blow off (LBO) approach based on the at least one value.

BRIEF DESCRIPTION OF THE DRAWINGS

Further characteristics and advantages of the invention will be more apparent from the description of a preferred but non-exclusive embodiment of the method and device illustrated by way of non-limiting example in the accompanying drawings, in which.

DETAILED DESCRIPTION OF THE PREFERRED EMBODIMENTS

Introduction to the Embodiments

A technical aim of the present invention therefore includes providing a method and device addressing the aforementioned problems of the known art.

Within the scope of this technical aim, an aspect of the invention is to provide a method and device that permit to ascertain the lean blow off (LBO) approach.

The technical aim, together with these and further aspects, are attained according to the invention by providing a method and device in accordance with the accompanying claims.

Advantageously, the method and device permit a clear identification of the individual mixing devices that are close to LBO, such that also reduction of CO and UHT coming from cold mixing devices is possible. In addition, implementation is easy and operational margins due to LBO can be greatly reduced.

DETAILED DESCRIPTION

With reference to the figures, these show a device for determining the approach of the lean blow off (LBO) of a gas turbine engine.

The gas turbine engine has a compressor, a combustion chamber and a turbine; alternatively it may also have a compressor, a first combustion chamber, a high pressure turbine and, downstream of it, a second combustion chamber and a low pressure turbine; in this case the device described in the following may be provided at the first and/or second combustion chamber. In addition, the engines may be provided or not with a flue gas recirculation system and/or a $CO_2$ capture unit.

Figure 1:
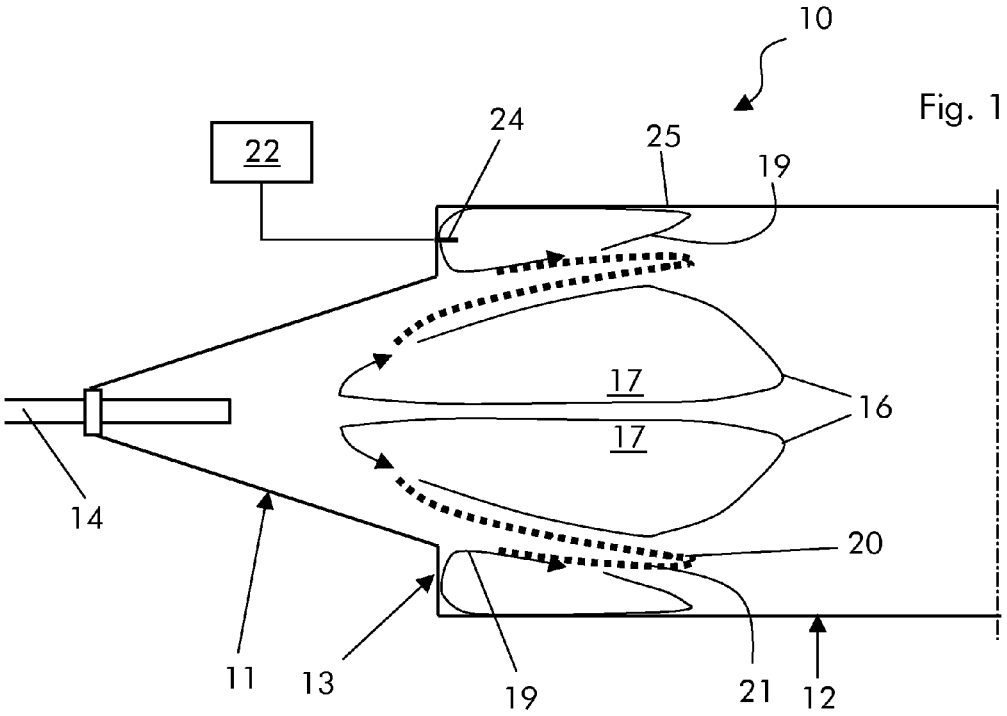
FIG. 1 is a schematic view of a combustion chamber operating at normal reactivity conditions.
Figure 2:
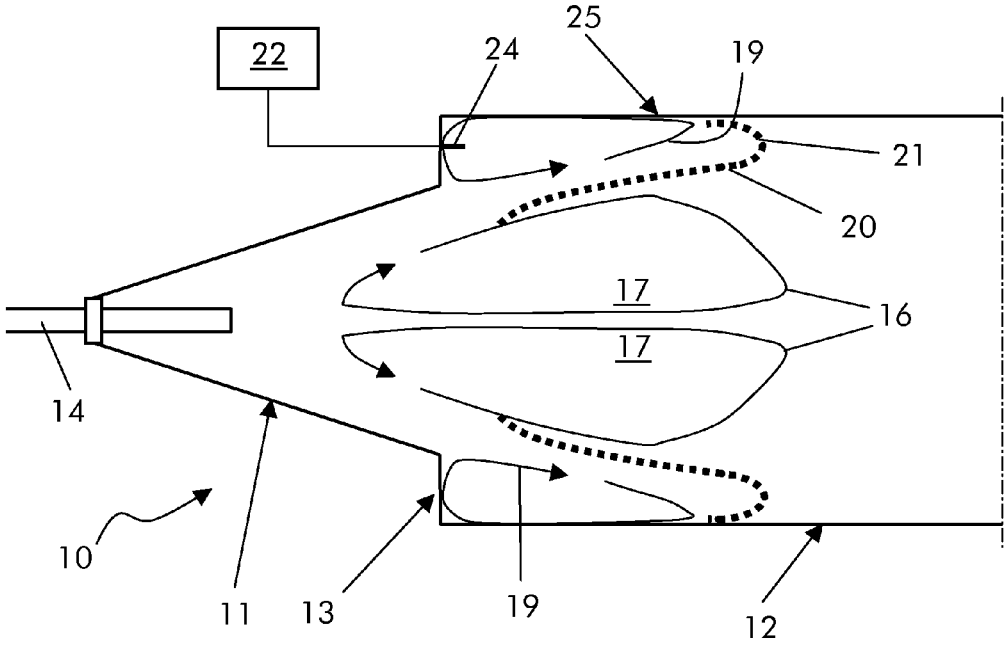
FIG. 2 is a schematic view of a combustion chamber operating at low reactivity conditions.

With particular reference to the combustion chamber 10, it comprises a plurality of mixing devices 11 all connected to an annular combustion device 12; between them a front plate 13 is provided (only a portion of the combustion chamber 10 is shown in FIGS. 1 and 2).

The mixing devices 11 are of a known type and for example have a substantially conical shape with tangential slots for air entrance and nozzles close to the slots for fuel supply. In addition a lance 14 is provided within each mixing device 11, for further fuel supply. Typically these mixing devices are part of the combustion chamber feeding a high pressure turbine (FIGS. 1 and 2).

Naturally, the mixing devices can also be different and for example they can comprise a channel with an inlet and an outlet, with a lance transversally protruding therein. Typically these mixing devices are part of the combustion chamber feeding a low pressure turbine.

Figure 3:
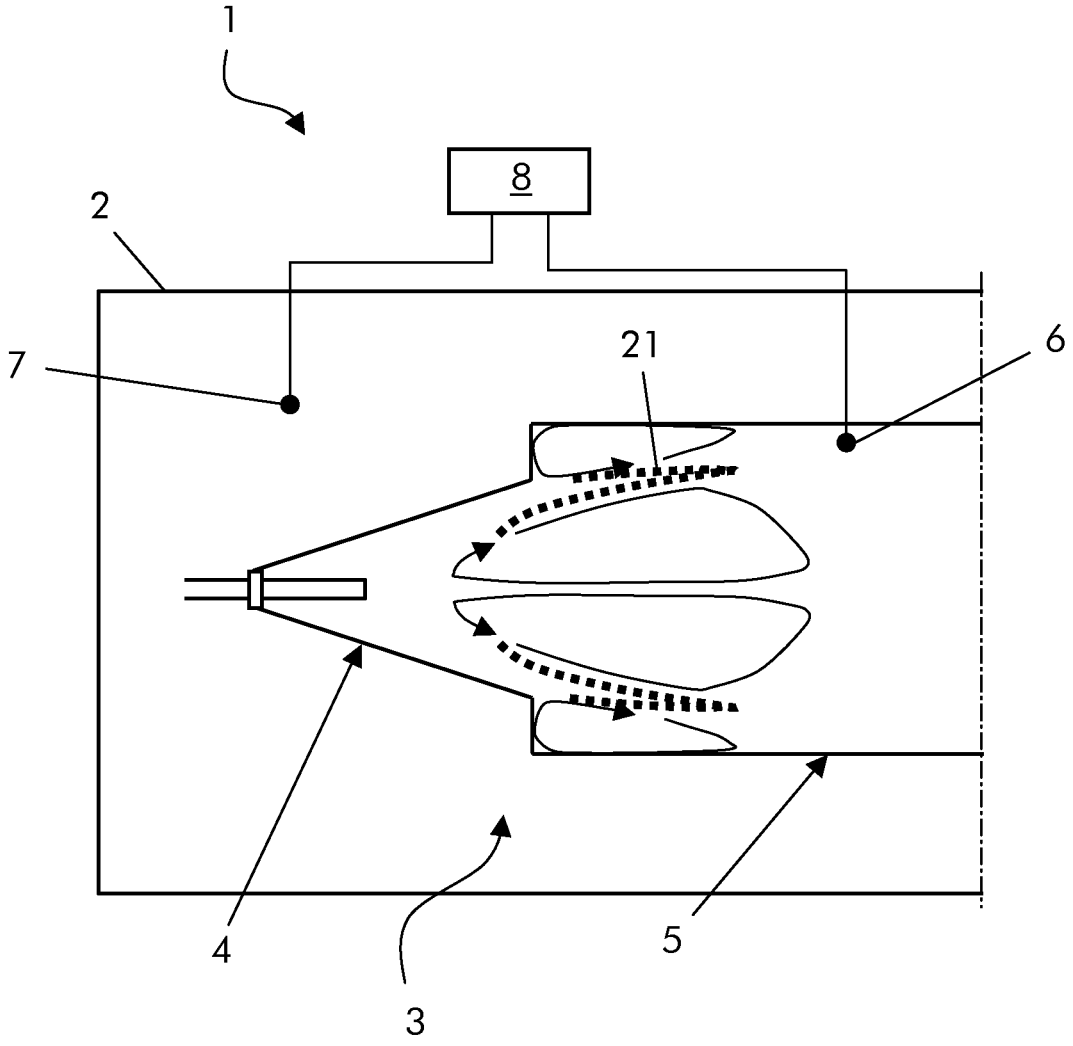
Fig. 3 PRIOR ART
FIG. 3 is a schematic view of a traditional combustion chamber with a traditional control system.

A plenum (not shown in FIGS. 1 and 2, but similar to the one shown in FIG. 3) is also provided housing all the mixing devices 11.

During operation an oxygen-containing fluid (oxidizer, typically air or air mixed with recirculated flue gases) is supplied into the plenum, such that it enters via the slots into the mixing devices 11; in addition, fuel is also supplied (via the lance 14 and/or the nozzles at the slots) into the mixing devices 11; fuel and oxygen-containing fluid thus mix (to form a fuel/oxygen-containing fluid mixture) and move toward the combustion device 12.

In the combustion device 12 recirculation areas exist.

First recirculation areas 16 are located directly in front of each mixing device 11; these recirculation areas 16 are generated by breaking of the vortices emerging from the mixing devices 11 and typically create central low pressure zones 17 with hot gas.

In addition, second recirculation areas 19 are generated at the sides of the recirculation areas 16; typically these recirculation areas 19 are caused by the sudden size increase at the front plate 13. The second recirculation areas 19 are located at radial inner and outer locations with respect to the recirculation areas 16.

When it enters the combustion device 12, the mixture comprising the fuel and oxygen-containing fluid starts to burn, generating flames 20, 21.

The recirculation areas 19 are provided over two concentric circumferences delimiting an annular space wherein the flames 20 and 21 are housed.

In particular, the flame 20 is stabilized and supported by the gas recirculating in the recirculation areas 16, and the flame 21 is stabilized and supported by the gas recirculating in the recirculation areas 19.

Fuel ignition depends of the reactivity conditions that, in turn, depend on the conditions of both the fuel and environment housing it.

FIG. 1 shows a situation in which the combustion chamber 10 operates at normal reactivity conditions, with the flames 20, 21 anchored immediately at the exit of the mixing device 11.

In contrast, FIG. 2 shows a situation in which the combustion chamber 10 operates at reduced reactivity conditions; it is evident that (in addition to other possible consequences), the flames 20, 21 shift downward and, in addition, the flame 21 looses stabilization (i.e. the gas recirculating in the recirculation areas 19 is not able to support the combustion anymore). In these conditions, the gas temperature in the recirculation areas 19 varies and typically decreases.

It was surprisingly ascertained that this temperature variation can be used as a reference for precisely determining the LBO approach.

In this respect, the device for determining the approach of the lean blow off has a computer system 22 with program codes receiving a value indicative of the temperature of the gas in the recirculation areas 19 adjacent to the flame; the program codes determine the lean blow off approach on the basis of this value.

The gas temperature in the recirculation areas 19 may be detected directly or indirectly or also calculated.

In a preferred embodiment, the device comprises a probe 24 for measuring the value indicative of the gas temperature in the recirculation areas 19.

For example, the probe 24 can indirectly measure the gas temperature in the recirculation areas 19 by measuring the temperature of the wall delimiting the recirculation areas 19.

In fact, tests showed that the temperature of the wall of the combustion device 12 is proportional to the burnt gas temperature over its whole length and therefore, when the flame temperature changes, the temperature of the combustion device wall also changes accordingly. In contrast, the temperature of the wall part of the combustion device 12 delimiting the recirculation areas 19 is practically not affected by the flame temperature alone, but it is mainly influenced by the gas temperature in the recirculation areas 19.

Preferably the probe 24 directly measures the gas temperature in the recirculation areas 19.

In this case the probe 24 is located between the mixing device 11 and combustion device 12 and/or at parts of the combustion device 12 facing the mixing device 11 and/or vice versa.

For example the probe 24 is a thermocouple mounted on the front plate 13 and protruding into the combustion device 12; this embodiment allows the influence of the cooling gas at the front panel 13 to be avoided or minimized.

Alternatively, the probe 24 may also be located at a position 25 at the lateral wall of the combustion device 12; in this case a position 25 where the recirculation areas 19 begins is particularly advantageous, since it allows influence of cooling and other extraneous effects be avoided (because measurement is carried out at the very beginning of the recirculation areas 19).

In a further embodiment, the probe 24 may also be located at the outlet of the mixing device 11.

Naturally, instead of the described thermocouple, different temperature probes may also be used.

The program codes define a threshold value $T_T$ (for example threshold temperature) such that, when the value indicative of the gas temperature in the recirculation areas 19 overcome (for example it goes below) such a threshold temperature $T_T$, lean blow off approach is imminent (and therefore countermeasures must be carried out).

Figure 4:
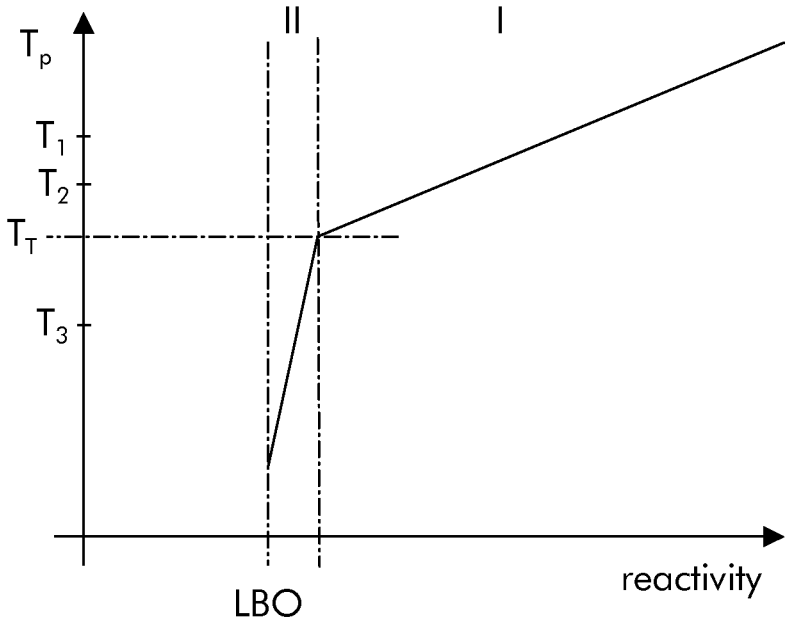
FIG. 4 is a diagram showing the relationship between the temperature detected by a probe and the reactivity conditions in an embodiment of the invention.
Figure 5:
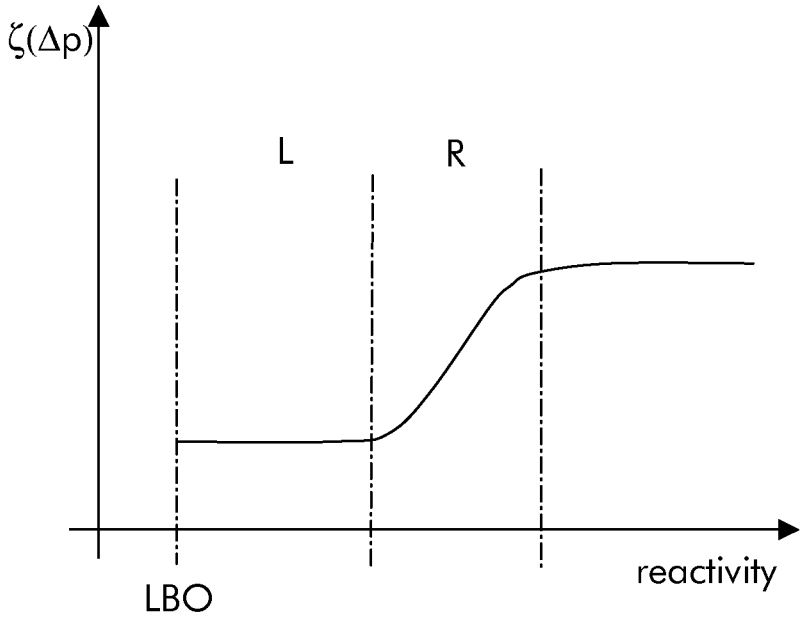
Fig. 5 PRIOR ART
FIG. 5 is a diagram showing the relationship between the parameter ζ and the reactivity conditions.

FIG. 4 shows the relationship between the value measured by the probe 24 ($T_p$) and the reactivity conditions; from this diagram it is apparent that two operating zones exist, a first zone I in which the reactivity allows operation of the engine quite far apart from the LBO and thus without troubling, and a second zone II in which operation occurs close to the LBO.

From the diagram of FIG. 4 it is apparent that in the first zone I the diagram has an inclination that is much greater than the inclination in the second zone II. This change of inclination can be used as a reference to ascertain the LBO approach.

In other words LBO approach may be recognized when a large change in the diagram inclination occurs, or after a fixed value interval (i.e. in the example described temperature interval from the temperature measured by the probe 24) from it.

The operation of the device is apparent from what described and illustrated and is substantially the following.

The engine operates at normal reactivity conditions (FIG. 1) and for example the value measured by the thermocouple probe 24 is $T_1$ that is greater than the threshold temperature $T_T$; therefore operation can be safely carried out since LBO is not imminent (FIG. 4).

Supposing the reactivity conditions change (in particular they decrease) for example because the flue gases recirculated into the gas turbine compressor via a flue gas recirculation system are increased or the environment temperature greatly drops.

This causes the flames 20, 21 to move downward (FIG. 2) and the flame temperature to decrease, causing the heat transferred from the flame 20, 21 to the recirculation areas 19 to decrease.

This causes the value measured by the probe 24 to decrease; for example the new value measured by the probe 24 is $T_2$.

Since $T_2$ is greater than the threshold temperature, also in this operating conditions operation can be safely carried out since LBO is not imminent (FIG. 4).

In contrast, in case the temperature measured by the probe 24 decreases to a value $T_3$ lower than the threshold temperature $T_T$, LBO approach is recognized (i.e. LBO is imminent) and countermeasures must be carried out (FIG. 4).

In the following also a method for determining the approach of the lean blow off conditions of a gas turbine engine is described.

The method includes determining a value indicative of the gas temperature in the recirculation areas 19 adjacent to the flame 20, and determining the lean blow off approach on the basis of this value.

In particular, the lean blow off approach is determined when the value indicative of the gas temperature in the recirculation areas 19 overcomes a threshold value $T_T$.

Advantageously, the value indicative of the gas temperature in the recirculation areas 19 is measured preferably outside of the flame.

It should be understood that the features described may be independently provided from one another. In practice, the materials used and the dimensions can be chosen at will according to requirements and to the state of the art.

REFERENCE CHARACTERS

1—traditional gas turbine
2—plenum
3—combustion chamber
4—mixing device
5—combustion device
6—pressure sensor
7—pressure sensor
8—control unit
R—operating zone
L—zone
ζ—parameter (function of Δp)
10—combustion chamber
11—mixing device
12—combustion device
13—front plate
14—lance
16—first recirculation areas
17—low pressure zones
19—second recirculation areas
20—flame
21—flame
22—computer system
24—probe
25—position
I—first zone
II—second zone
$T_p$—value measured by the temperature probe
$T_T$—threshold temperature
$T_1$, $T_2$, $T_3$—operating temperatures
LBO—lean blow off

What is claimed is:

1. A method for determining an approach of lean blow off of a gas turbine engine having at least one combustion chamber, into which a fuel is supplied and burned to generate a flame, the method comprising:

measuring a gas temperature in recirculation areas inside the at least one combustion chamber adjacent to the flame such that the gas temperature is measured inside the at least one combustion chamber; and determining, by a computer system executing computer-readable instructions, the lean blow off approach based on the measured temperature value.

2. The method according to claim 1, wherein the gas temperature in the recirculation areas is directly measured.

3. The method according to claim 2, wherein the gas temperature in the recirculation areas is directly measured by a probe.

4. The method according to claim 3, wherein the probe is comprised in the at least one combustion chamber.

5. The method according to claim 1, wherein the recirculation areas in which the gas temperature is measured are outside of the flame.

6. The method according to claim 5, wherein the at least one combustion chamber includes at least one mixing device connected to at least one combustion device, and wherein the recirculation areas in which the gas temperature is measured are located at least one of between the at least one mixing device and the at least one combustion device, and at parts of the at least one combustion device facing the at least one mixing device.

7. The method according to claim 1, wherein the lean blow off is determined to be approached when the measured temperature in the recirculation areas overcomes a threshold value.

8. The method according to claim 1, wherein the gas temperature in the recirculation areas is indirectly measured by a probe measuring a temperature of at least one wall delimiting the recirculation areas.

9. The method according to claim 1, wherein the at least one combustion chamber includes at least one mixing device connected to at least one combustion device of the at least one combustion chamber, and wherein the recirculation areas in which the gas temperature is measured are immediately at an exit of the at least one mixing device.

10. A device for determining an approach of lean blow off of a gas turbine engine having at least one combustion chamber into which a fuel is supplied and burned to generate a flame, the device comprising:

a measuring instrument configured to measure a gas temperature in recirculation areas inside the at least one combustion chamber adjacent to the flame such that the gas temperature is measured inside the at least one combustion chamber; and a computer system configured to determine the lean blow off approach based on the at least one measured temperature value.

11. The device according to claim 10, wherein the measuring instrument comprises a probe configured to measure the gas temperature in the recirculation areas.

12. The device according to claim 11, wherein the probe is configured to directly measure the gas temperature in the recirculation areas.

13. The device according to claim 11, wherein the at least one combustion chamber includes at least one mixing device connected to at least one combustion device, and wherein the probe is located at least one of between the at least one mixing device and the combustion device, and at parts of the at least one combustion device facing the at least one mixing device.

14. The device according to claim 11, wherein the probe is configured to indirectly measure the gas temperature in the recirculation areas by measuring a temperature of at least one wall delimiting the recirculation areas.

15. The device according to claim 10, wherein the computer system is configured to define a threshold value and determine the lean blow off approach when the measured gas temperature in the recirculation areas overcomes the defined threshold value.

16. The device according to claim 10, wherein the at least one combustion chamber includes at least one mixing device connected to at least one combustion device of the at least one combustion chamber, and wherein the recirculation areas in which the gas temperature is measured are immediately at an exit of the at least one mixing device.

* * * * *